United States Patent [19]

Loeb

[11] 4,416,177

[45] Nov. 22, 1983

[54] DATA INPUT FOR COMPUTER ORGAN

[76] Inventor: Marvin Loeb, 2120 Middlefield Rd., Palo Alto, Calif. 94301

[21] Appl. No.: 239,849

[22] Filed: Mar. 2, 1981

[51] Int. Cl.[3] ..... G10H 1/02

[52] U.S. Cl. ..... 84/1.19; 84/1.18; 84/1.03; 84/115

[58] Field of Search ..... 84/1.18, 1.28, 115, 84/1.03, 1.19; 235/436, 437, 438, 454, 455

[56] References Cited

U.S. PATENT DOCUMENTS

| | | | |
|---|---|---|---|
| 3,213,179 | 10/1965 | Clauson | 84/1.18 |
| 3,420,940 | 1/1969 | Glass et al. | 84/1.18 |
| 4,157,049 | 6/1979 | Watanabe | 84/1.24 |
| 4,161,901 | 7/1979 | Walker | 84/115 |
| 4,214,501 | 7/1980 | Von Kemenczky | 84/1.28 |

*Primary Examiner*—F. W. Isen

*Attorney, Agent, or Firm*—John L. McGannon

[57] ABSTRACT

Computer organ tone input for alterable stops is achieved by single-key input through a decoded keyboard which is couple to a logic network and optoelectrical output drive circuitry. The decoder circuitry activates selected optical emitters in an array which is mounted in the optical reader of a computer organ such that the decoder circuitry is electronically isolated from the computer organ. The invention eliminates the need for a tone card library, does not interfere with the sensitive circuitry of the organ and permits instantaneous reprogramming of alterable voices.

2 Claims, 1 Drawing Figure

DATA INPUT FOR COMPUTER ORGAN

BACKGROUND OF THE INVENTION

1. Field of Invention

This invention relates to delivery and control of data and data sequences representing musical waveforms to a digital computer organ or synthesizer. The digital computer organ was first developed by the Allen Organ Company of Macungie, Penna. in 1968. Organs of interest to the subject invention include the Allen System 122, 123, 203, 204, 301, 433, 436, 462, and 903. Other multiple computer Allen organs can make use of the invention by applying it to one of the computers or by using more than one invention in each organ configuration. In addition, selected other labels manufacture digital computer organs and synthesizers such as RMI (Rocky Mount Instrument). This invention is related to any organ that makes use of an optical punched card or paper tape reader.

Voice generation in each of the above organs is controlled by a digital computer. On digital computer organs with an optical card reader one or more of the voice register contents ae alterable, a process called voice programming. Voice programming is accomplished during a performance in the following manner: an alterable voice selection switch is set, then a prepunched paper card is inserted into the card reader. This process is repeated for each new voice entered. Thus, voice programming is slow and cumbersome, making it very difficult to alter voices during performance, a frequently desired action. Voice programming during a performance or a religious service is particularly desirable for smaller organs, since it increases the versatility of the organ by increasing the effective number of voices available in the organ registration.

The manufacturer of the computer organs currently has a standing policy of refusing to provide prepunched cards on a custom basis. Composite timbre cards are available on only a very limited basis. The ability to modify data voice characteristics, either pre-stored in the organ computer memory or introduced by the card reader is also desirable. What is therefore needed is a system taking advantage of the alterable voice reaader which enables a user to reprogram the digital computer organ substantially instantaneously. Still further, what is needed is a system to enable a computer organ user to program a composite voice during a single entry process. Furthermore, what is needed is the capacity to modify existing voice data to change tonal characteristics or amplitude. Still further, these functions need to be accomplished in a user oriented manner that is both economical and reliable. In addition, what is needed is a voice altering system which will retrofit to the digital computer organ. Finally, is is desirable to lessen or eliminate the reliance on the cumbersome card library and to increase the effective number of registers of the organ. The functions must be accomplished in a manner which does not require any modification of the computer circuitry nor which presents a problem of potential interference with circuits relates to the organ computer or its input interfaces.

2. Description of the Prior Art

The following patents and publication were uncovered in a search of prior art references in the United States Patent and Trademark Office:

U.S. Pat. No. 3,213,179;

U.S. Pat. No. 3,885,110;
U.S. Pat. No. 3,978,755;
U.S. Pat. No. 4,119,006;
U.S. Pat. No. 4,134,321;
U.S. Pat. No. 4,134,323; and The publication of an advertisement for a currently available system in the December 1979 issue of the *Computer Music Journal* which shows two types of keyboards, one related to selecting pitch and one for dynamic harmonic control.

U.S. Pat. No. 3,213,179 discloses a card reader for a musical organ in which the card is inserted between the ends of a number of fiberoptic bundles. The light source directs light through the upper bundles and through the holes in the card to the lower bundles and to actuate photoconductive devices. There is no suggestion in this patent of bypassing the use of the card.

U.S. Pat. No. 3,885,110 shows the use of the keyboard for energizing light sources which are coupled by fiberoptic rods to a rotatable disk having actual musical notes recorded thereon. This patent does not suggest the use of a keyboard with a computer-operated organ. The remaining four patents are owned by Allen Organ Company, none of which relate to apparatus of the type herein disclosed and claimed.

The advertisement shows the use of an alphanumeric keyboard for data input into a memory and control device which can be called back by the master or pitch keyboard of the musical instrument. A block diagram on one page of the advertisement shows direct coupling between the two keyboards. This advertisement, under the trade name of Fairlight, also suggests that data can be entered into the master keyboard by drawing curves directly onto a screen with a light pen. Light pen input to computers is already in extensive use in the industry and does not represent a unique feature of this instrument. The instrument does not use a card reader for input and thus do not relate to the type of apparatus of the type herein disclosed and claimed.

SUMMARY OF THE INVENTION

According to the invention, an input connection is provided to the-alterable voice input of the digital computer organ which modifies the contents of the alterable voices registers of the organ. The invention comprises a keyboard, an encoder/decoder circuit, logic and control network circuitry, output drive circuitry, solid state memory and an array of optical emitters mounted in a matrix matching the pattern of the existing optical sensors in the optical card reader of the digital computer organ.

The logic network and control circuitry in connection with the decoder circuit generates a pattern which is essentially equivalent to the pattern of sixteen words plus control bits found on the prepunched computer cards. This data sets all of the levels of a waveform to be synthesized in the digital computer organ in response to a single key stroke instead of—selecting from a deck of over a hundred cards, the selection of the particular alterable voice assignment, the insertion into the card reader slot and subsequent withdrawal of the card by the user. The optical emitters are inserted in the optical reader in a manner to line up with the optical sensors therein.

The invention gives the user of the instrument greater facility in changing the contents of the alterable voice registers. This change is virtually instantaneous since it is accomplished by merely pushing the appropriate buttons on the invention keyboard.

The keyboard virtually eliminates the need for an extensive tone card library since the memory of the invention digital system can store all of the information needed to replicate the contents of all of the alterable voice cards available for the digital computer organ, or a portion of those cards, if desired. Moreover, the keyboard enables the user to alter voices with a single key stroke, or at most two or three key strokes, to call up the pattern of digital bits necessary for voice programming. In addition functional control switches would enable storing or recalling sequences of alterable voices on single keystroke command or setting voice amplitude levels.

A peculiar feature of digital computer organs is that the level and timbre of a voice is set by the amplitude and waveform data stored in the computer memory. For general volume control there is a pedal on electronic organs which varies the input level to the organ amplifiers. This pedal cannot set the loudness of any one voice relative to the loudness of the other voices which may be speaking at the same time. The invention would enable changing this relative loudness by arithmetically modifying with constant factors the input waveform ordinate values prior to insertion into the organ itself.

One feature of this invention is the manner of interface with the internal circuitry of the digital computer organ. The connection is made in a noninvasive optical way by using the receivers preexistant in the card reader of the instrument. Thus, no modifications of the digital computer organ are necessary which would require internal electrical and/or software changes. Such changes introduce problems in internal organ computer programming, circuit design and loading; they would also increase noise and ground loop problems. In addition, modification to the organ circuitry by users is potential grounds for voiding a service or parts warranty.

Since the invention is noninvasive, that is, it does not involve direct interface with the sensitive computer circuitry of the organ, it cannot introduce any problems related to direct connection. Direct connection with an input port of the organ computer might seem suggested; however, the distinct advantage of the invention it that substantially no modification or redesign of an existing system is required.

BRIEF DESCRIPTION OF THE DRAWING

The invention will be best understood by reference to the following detailed description taken in conjunction with the accompanying drawing FIG. 1.

DETAILED DESCRIPTION OF PREFERRED EMBODIMENTS

Figure 1:
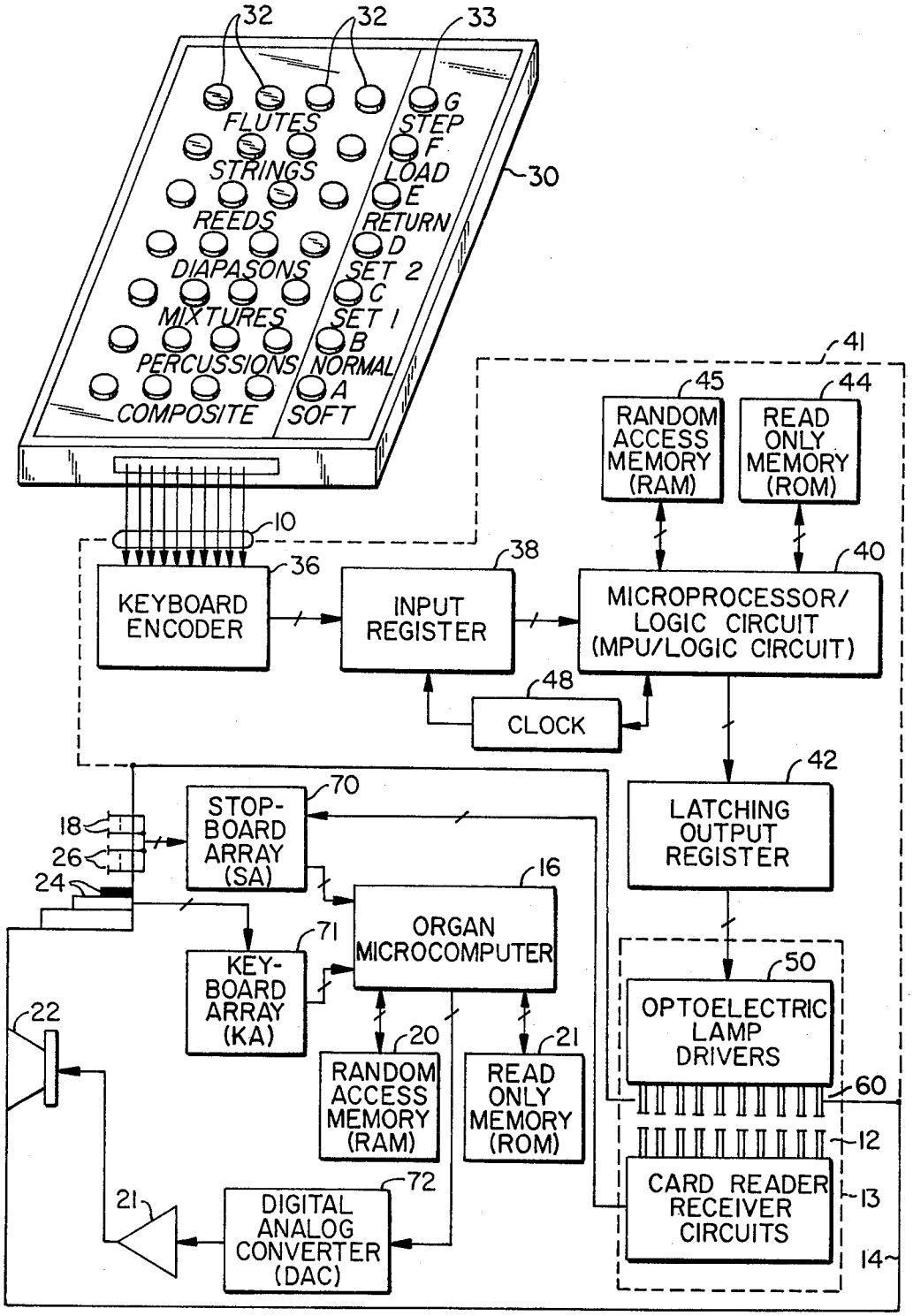
FIG. 1 depicts a keyboard and partial block diagram of the system according to the invention.

Turning to FIG. 1, the invention is illustrated in functional form. The apparatus according to the invention is a keyboard 30 which drives an auxiliary electronic system 41. The system 41 optically interfaces card reader receivers 12 in a card reader 13 of a digital computer organ 14. Encoding of the keyboard output 10 is accomplished by depressing a key 32 or 33 on the keyboard 30, to which the Microprocessor/Logic Circuit (MPU/-Logic Circuit) 40 responds to generate an output.

The digital computer organ 14 includes, in addition to the card reader 13, a microcomputer 16 which is coupled to front panel alterable voice stop switches 18 through an interfacing device called the stopboard array electronics (SA) 70. The stopboard array electronics (SA) 70 contains provision for storing and exciting alterable voices in accordance with a digital input through the receivers 12. This circuitry addresses alterable voice storage (RAM) 20 via microcomputer 16. The alterable voice storage (RAM) 20 is processed by the organ's microcomputer 16 along with any other speaking voices activated by fixed stops 26. The microcomputer 16 output is converted from a digital to analog signal in a digital to analog converter (DAC) 72 and amplified by amplifier 21 prior to driving speaker system 22. The organ keys 24 select via the key select array electronics (KA) 71 the pitch that is assigned to the waveforms of the alterable stops 18 and fixed stops 26. The alterable voice storage 20 thus stores a synthesized representation of the waveform. Microcomputer 16 operating sequences are stored in the read only memory (ROM) 21.

The auxiliary electronic system 41 is described as follows. The keyboard 30 generates a binary or on-off signal in response to individual key actuation. The signal is fed to a keyboard encoder 36. The encoder 36, which may be adjacent to or remote from the keyboard 30, generates a unique digital word representative of the key which has been actuated and conveys that digital word to a input register 38. The storage register 38 is addressed by the MPU/Logic Circuit 40 so as to transfer the datum to the random access memory (RAM) 45 which temporarily holds the unique word. The input register 38 is coupled, either directly or through a cable, to the MPU/Logic Circuit 40. The MPU/Logic Circuit 40 is operated to generate a digital sequence through a parallel output register 42. The digital sequence is the digital encoding to which the microcomputer 16 of the organ 14 is responsive. The sequence set is chosen to represent the waveform to be reproduced, plus interspersed control bits to meet organ computer input requirements.

A catalogue of sequences is stored in a read only memory (ROM) library 44 addressed by the MPU/-Logic Circuit 40. Specifically, the electronic system 41 includes memory address logic responsive to the contents of the input register 38, and a clock 48, coupled to address logic (not shown) within the MPU/Logic Circuit 40 for timing and controlling the sequential operations of the address logic. The ROM library 44 has as its address input the result of MPU/Logic Circuit 40 processing, and its data output forms the input to the parallel output register 42.

The output of a latching output register 42 is coupled in parallel to optoelectrical lamp drivers 50. In the specific embodiments contemplated for the Allen-brand computer organs of interest, the drivers are a single column of ten lines. The number of lines represents the number of lamps required to match the number of reader receivers 12 and necessary to excite each one of the receivers 12 of the optical card reader 13.

The driver assembly 50 is coupled to optoelectrical emitters or lamps 60 which have a spectral characteristic intended to match the spectral characteristics of the optical receivers 12 in the card reader 13. The output lamps 60 may be separately mounted in an array to confront the receivers 12. Since the optical emitters 60 in the card reader 13 are isolated from the sensitive computer circuitry of the organ 14, there is minimal danger of interference with sensitive circuitry therein.

Referring to the memory address logic of the MPU/-Logic Circuit 40, the circuitry functionally comprises a decoding process which accepts the unique input digital word from input register 38, recognizes the digital word as a pointer to an address in the ROM library 44, and increments the pointer through a preselected number of addresses. The sequence is terminated once it has been loaded into the computer organ 14. The ROM library 44 is preprogrammed with the selected catalogue of waveforms in accordance with the waveform reconstruction of the steady state musical tones. New waveforms may be computed, or they may be empirically determined by use of a waveform analyzer, for synthesis in the ROM library 44.

In a more advanced embodiment, the MPU/Logic Circuit 41 may contain additional functions based on application of a dedicated microcomputer capable of more sophisticated interpretation of keyboard input signals. The keyboard input layout is determined according to the level and type of usermachine interface. For example, a user could require the same voice to be inserted at different relative loudness levels. Thus keyboard 30 could contain keys 33 for setting these voices to different relative loudness. Another example would be to store voices in a sequence by entering selections via keyboard 30, then using a single key of keyboard 30 to recall each sequence step in turn.

The invention has now been explained with reference to specific embodiments. Other embodiments will be apparent to those of ordinary skill in the art. Accordingly, it is not intended that this invention by limited except as indicated by the appended claims.

What is claimed is:

1. In combination a digital computer organ equipped with an optical card reader having a number of optical sensors in a pattern and operable for altering the contents of a number of voice patterns of the organ;

a keyboard with a plurality of keys, a first group of keys of the keyboard being specific to selected voice patterns of said computer organ, and a second group of keys of the keyboard being function keys for modification of a selected voice pattern, said keyboard being operative to generate a binary signal to indicate actuation of individual keys of the keyboard;

a decoder responsive to said binary signal for generating a unique digital word identifying a selected voice pattern;

a storage register for temporarily storing said digital word from said decoder;

a circuit means responsive to said stored word in said storage register for generating a plurality of digital bytes in a preselected sequence;

a number of optoelectrical emitters adjacent to and arranged in an array matching the pattern of said optical sensors of said optical card reader of said digital computer organ; and a number of drivers coupled to said optoelectrical emitters and responsive to said sequence of bytes for driving corresponding optoelectrical emitters such that signals applied to said emitters are recognizable at corresponding optical sensors of the organ as a programming pattern for alterable voice patterns of said digital computer organ.

2. An apparatus according to claim 1 wherein said byte generating circuit means comprises:

memory address and control logic circuit means coupled to receive the output of said storage register and for supplying address information to a digital memory means;

a digital memory means having randomly addressable storage registers, said memory means being coupled to receive the output of said memory address and control logic means for supplying a sequence of parallel data bit signals to a parallel output register in response to an input address, said digital memory means including read only memory means and random access memory means;

a parallel output register coupled to receive data output of said digital memory means, said output register having parallel outputs coupled to said drivers; and means for generating a gated signal coupled to said memory address and control logic circuit means for providing a signal to said memory address and control logic, in order to increment addresses of said read only memory means, said read only memory means being structured to contain preselected digital data specifying selected samples of at least one synthesized waveform which are intelligible by a computer within said digital computer organ.

* * * * *